US007856107B2

(12) United States Patent
Siltmann

(10) Patent No.: US 7,856,107 B2
(45) Date of Patent: Dec. 21, 2010

(54) HEARING DEVICE WITH AUTOMATIC DETERMINATION OF ITS FIT IN THE EAR AND CORRESPONDING METHOD

(75) Inventor: Simone Siltmann, Lohne (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 1188 days.

(21) Appl. No.: 11/489,879

(22) Filed: Jul. 20, 2006

(65) Prior Publication Data

US 2007/0019817 A1 Jan. 25, 2007

(30) Foreign Application Priority Data

Jul. 22, 2005 (DE) ..... 10 2005 034 380

(51) Int. Cl.
*H04R 25/00* (2006.01)

(52) U.S. Cl. ..... 381/60; 381/312

(58) Field of Classification Search ..... 381/60, 381/312, 315

See application file for complete search history.

(56) References Cited

U.S. PATENT DOCUMENTS 5,584,869 A 12/1996 Heck et al.
7,242,778 B2 * 7/2007 Csermak et al. ..... 381/60
2002/0176584 A1 * 11/2002 Kates ..... 381/60
2003/0007647 A1 * 1/2003 Nielsen et al. ..... 381/60

FOREIGN PATENT DOCUMENTS

DE 41 28 172 A1 3/1993
DE 100 38 118 A1 2/2002

* cited by examiner

*Primary Examiner*—Brian Ensey

(57) ABSTRACT

The risk of inadequate hearing device provision for the hearing-impaired is to be reduced. To this end provision is made to determine the correct fit of the hearing device or the hearing device component in an auditory canal. To this end an acoustic measurement signal is output into the auditory canal. The measurement signal influenced in the auditory canal by the hearing device or the hearing device component is received and compared with a reference signal. Information about the fit of the hearing device is determined from the comparison. This information is transmitted with a status report to an external unit. Objective information about the fit of the hearing device can thus be obtained, particularly in the case of provision for children.

16 Claims, 1 Drawing Sheet

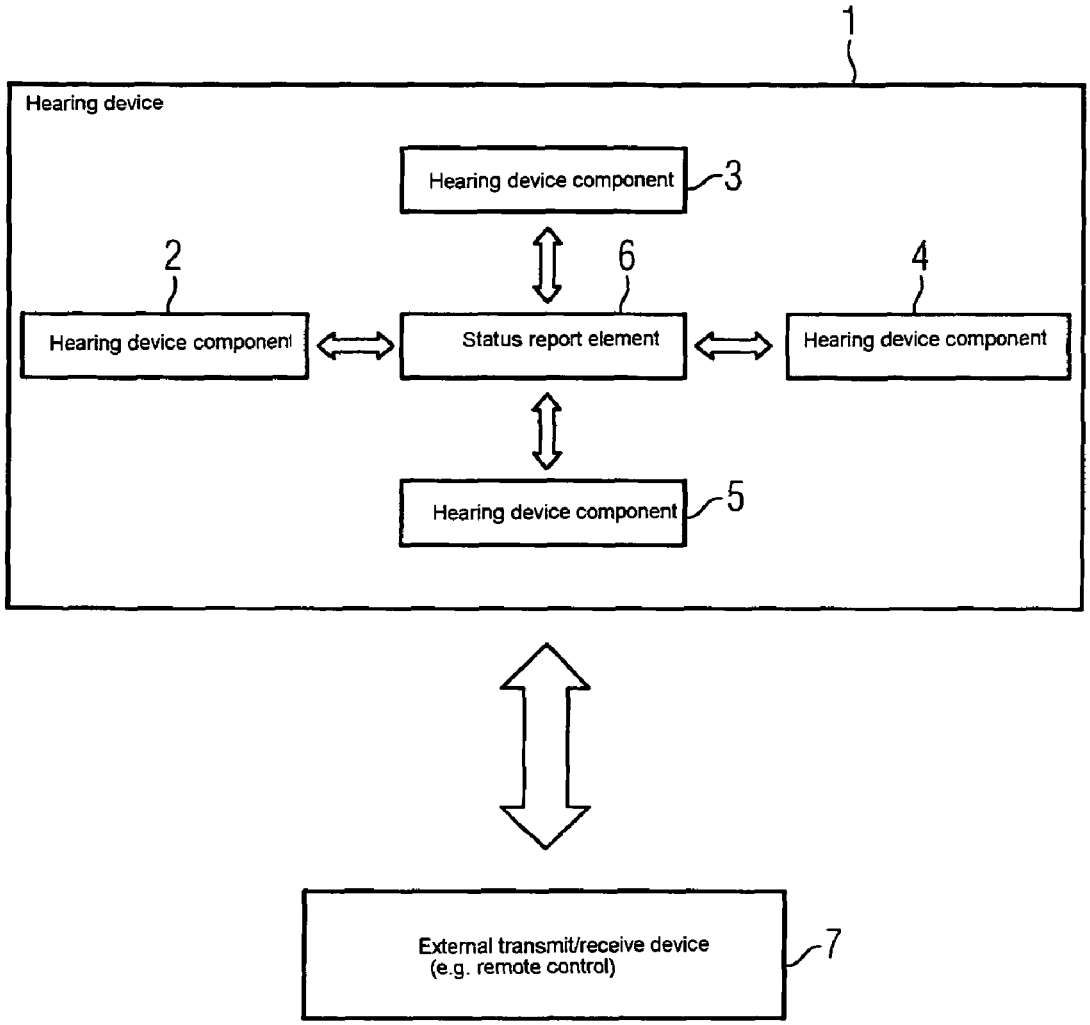
1
Hearing device
Hearing device component
3
2
6
4
Hearing device component
Status report element
Hearing device component
Hearing device component
5
External transmit/receive device
(e.g. remote control)
7

HEARING DEVICE WITH AUTOMATIC DETERMINATION OF ITS FIT IN THE EAR AND CORRESPONDING METHOD

CROSS REFERENCE TO RELATED APPLICATIONS

This application claims priority of German application No. 10 2005 034 380.5 filed Jul. 22, 2005, which is incorporated by reference herein in its entirety.

FIELD OF THE INVENTION

The present invention relates to a hearing device which can be arranged totally or partially in the auditory canal. Furthermore the present invention relates to a method for determining the fit of a hearing device or a hearing device component in an auditory canal.

BACKGROUND OF THE INVENTION

In principle it is difficult to assess the fit of the hearing device or of the hearing device component in the auditory canal of the user from the outside. This is a significant problem particularly when supplying children with hearing devices. Furthermore the subjective assessment of the hearing device wearer about the fit of his/her hearing device is not always very meaningful. The experience of the hearing device wearer with hearing devices is of significance here. The problem further occurs particularly with babies and small children that the auditory canal grows very quickly, thereby rendering a constant control of the fit of the hearing device or the corresponding hearing device component necessary.

Hearing devices are known, with which the status of the battery is transmitted outward to the remote control for instance. Furthermore, the publication DE 100 38 118 A1 discloses a method, by means of which the status of the hearing device can be called up by means of remote data transmission. This is helpful for the hearing device acoustician if he/she finds out from the hearing device wearer that the function of his/her hearing device is impaired.

Furthermore, the publication U.S. Pat. No. 5,584,869 describes an implantable hearing device with a transmit/receive unit. In the case of a fault, signals can be sent to a control center which displays the status.

SUMMARY OF THE INVENTION

The object of the present invention consists in further reducing faults when a hearing aid is in use.

According to the invention, this object is achieved by a hearing device with a signal playback facility for the acoustic playback of a measurement signal for the determination of the fit of the hearing device or a hearing device component in an auditory canal, a microphone facility for receiving the measurement signal in the auditory canal influenced by the fit of the hearing device or the hearing device component, a signal processing facility for controlling the signal playback facility and for comparing the measurement signal received by the microphone device with a predetermined reference so that information about the fit of the hearing device or the hearing device component can be determined from the comparison and an output facility for outputting or providing information about the fit of the hearing device to/for an external unit.

Furthermore provision is made for a method for determining the fit of a hearing device or a hearing device component in an auditory canal by the acoustic playback of a measurement signal in the auditory canal, receipt of the measurement signal influenced by the fit of the hearing device or of the hearing device component in the auditory canal, comparing the received measurement signal with a predetermined reference, determining information about the fit of the hearing device or of the hearing device component from the comparison and outputting or providing information about the fit of the hearing device to/for an external unit.

According to the invention, the frequently occurring fault of a poor fit of the hearing device or a hearing device component in the auditory canal of the user is thus automatically monitored. This fault is not simply a fault inherent in the hearing device but a fault which results from the contour or alignment of the hearing device and/or of the hearing device component in relation to the auditory canal of the user.

A storage facility for storing a reference signal is preferably provided in the hearing device, said reference signal serving as a comparison reference. A mutual comparison of signals generally supplies more information than the comparison with a predetermined threshold value.

The reference can comprise a tolerance range, with the aid of which information about the fit of the hearing device or the hearing device component is determined. This means that only a clearly incorrect fit of the hearing device or the hearing device component is reported as a fault. The tolerance range should however not be too great so that an inaccurately fitting otoplastic is identified for instance. This is particularly important for children.

Furthermore it is particularly advantageous if the output facility is designed to output or provide a status report, which contains inter alia information about the fit of the hearing device or the hearing device component (e.g. otoplastic). Additional information contained in the status report can also include data about the status of at least one microphone and/or speaker. A status report of this type can be evaluated in a more user-friendly manner by the hearing aid wearer or acoustician than numerous individual items of information.

The signal processing facility of the hearing device allows information about the fit of the hearing device or the hearing device component to be re-determined at regular time intervals. Alternatively and in addition, this information can also be made available each time the hearing device is turned on. The hearing device thus automatically carries out self-tests according to a predetermined pattern without monitoring by the hearing device wearer or the acoustician.

Information about the fit of the hearing device or the hearing device component can however also be determined based on activation of a remote control of the hearing device. This is advantageous if the hearing device wearer or acoustician suspects an incorrect fit and requires corresponding information to this end from the hearing device.

BRIEF DESCRIPTION OF THE DRAWINGS

The present invention is now described in more detail with reference to the accompanying drawing, which shows a basic signal flow diagram to an inventive hearing device. The exemplary embodiment described in further detail below represents a preferred embodiment of the present invention.

DETAILED DESCRIPTION OF THE INVENTION

An inventive hearing device is able for instance to monitor the functionality of different components of the hearing device with the aid of a status report element, to collate this in the form of a status report and to transmit this to an external transmit/receive device.

The status report contains those essential points which reflect the functional status of the hearing device. These include for example a report about the operating voltage of the battery, the functionality of the receiver and the microphone, the fit of the ear mold etc.

What is known as a "status report element" is a basic element for the realization selected here. This status report element is able to call up and store the status of the different hearing device elements and/or components. A self-test routine determines the functionality of the components each time the hearing device is turned on. All the results of the inquiry are collated in the status report. The status report is then sent to a remote control of the hearing device.

To ensure that the hearing device wearer or acoustician can obtain a status report at any time, the self-test routine can be triggered by activating the remote control. In this instance too the results are collated into a status report and sent to the remote control.

If the status report element indicates a fault, an easily understandable fault notification is output depending on the fault. By way of example, the following alarm message appears on the remote control, if the microphone or receiver is faulty: "Warning: a defect has occurred". "Please consult your hearing device acoustician immediately". In the case of a poorly fitting otoplastic, the alarm message "Warning: check the fit of the ear mold" appears.

The composition of a status report is schematically reproduced in the FIGURE. A hearing device 1 features a number of hearing device components 2, 3, 4 and 5. By way of example, the hearing device component 2 symbolizes the signal playback facility for the acoustic playback of a measurement signal for the determination of the fit of the hearing device or otoplastic in the auditory canal as well as the associated microphone to receive the correspondingly influenced measurement signal.

Each of the hearing device components 2 to 5 now supplies status information about itself to a status report element, if necessary on request. By way of example, the hearing device component 2 sends status information about the fit of the hearing device or the otoplastic. This status information for instance indicates an incorrect fit of the otoplastic.

A status report is now collated by the status report element 6 in the hearing device from the status information of all hearing device components 2 to 5. This status report is either simply provided so that it can be transmitted outward to an external transmit/receive device 7 when called up. When the status report 6 has been collated, it can however also be sent directly to the external unit without an external request.

A reference for the fit is stored in the status report element 6 in order to determine the fit of the ear mold or the ITE hearing device. This reference is determined beforehand, in that a test signal is emitted by the hearing device receiver when the ear mold is first worn and a measurement is carried out at the hearing device microphone to establish how much of the test signal is received. This test signal is generated for instance with the aid of a sinus generator. The transmission function of the receiver-ear mold-microphone attenuation path is then stored as a reference. When the hearing device is turned on at the ear, the test routine runs again by transmitting the test signal and receiving an attenuated signal. If the measured curve differs from the reference with regard to certain measurement tolerances, this can be evaluated as an indication of an incorrectly fitting otoplastic. A corresponding input is made in the status report element.

The functionality of a microphone can be recorded in a similar manner in the status report. The impedance of the hearing device microphone is measured to this end. The impedance in the functional state differs from the impedance in the defective state. The impedance measurement thus determines whether the microphone is electrically defective, in that the actual status of the impedance value corresponds to the expected target status.

The functionality of the speaker can likewise be stored in the status report. The impedance of the hearing device speaker is also measured to this end. If there are differences between the actual value and a target value, it can be assumed that there is a defect in the speaker.

The transmission of a status report is a valuable function of a hearing device particularly for adjustments for children. Babies and small children are unable to describe the precise status of their hearing device, e.g. a discharged battery. Even if parents monitor the status of the hearing device regularly, faults such as for instance a defective amplifier etc. are not correctly identified in cases of doubt, so the child can no longer be guaranteed adequate amplification. The transmission of a status report by the hearing device based on a self-test reduces the risk of such inadequate provision for children. The transmission of a status report is however also of considerable benefit when providing hearing devices for adults and particularly also for elderly people and people with other physical and mental handicaps.

The invention claimed is:

1. An automatically monitored hearing device, comprising:

a hearing device component that fits in an auditory canal of a user of the hearing device;

a signal playback facility for an acoustic playback of a measurement signal which measures a fit of the hearing device component;

a microphone facility for receiving the measurement signal influenced by the fit of the hearing device component;

a signal processing facility for controlling the signal playback facility and for comparing the measurement signal received by the microphone facility with a predetermined reference; and an output facility for outputting an information about the fit of the hearing device component to an external unit based on the comparison, wherein the fit of the hearing device component describes an alignment of the hearing device component with respect to the auditory canal of the user.

2. The hearing device as claimed in claim 1, wherein the hearing device has a storage facility for storing a reference signal which serves as a comparison reference.

3. The hearing device as claimed in claim 1, wherein the predetermined reference comprises a tolerance range which is used to determine the fit of the hearing device component.

4. The hearing device as claimed in claim 1, wherein a status report is output by the output facility to the external unit.

5. The hearing device as claimed in claim 4, wherein the status report comprises an element which is selected from the group consisting of: an operating voltage of a battery of the hearing device, a function status of the hearing device component, the information about the fit of the hearing device component, and a combination thereof.

6. The hearing device as claimed in claim 1, wherein the hearing device component is a microphone or a speaker.

7. The hearing device as claimed in claim 1, wherein the signal processing facility determines the fit of the hearing device component at a regular time interval.

8. The hearing device as claimed in claim 1, wherein the signal processing device determines the fit of the hearing device component at the time when the hearing device is turned on.

9. The hearing device as claimed in claim 1, wherein the signal processing device determines the fit of the hearing device component by an activation of a remote control of the hearing device.

10. The hearing device as claimed in claim 1, wherein a fit of the hearing device in the auditory canal is measured, played back, processed, and output.

11. The hearing device as claimed in claim 1, wherein the user is:

unable to describe a status of the hearing device component, and a child, elder, or a person with a physical or a mental handicap.

12. A method for determining a fit of a hearing device having a hearing device component in an auditory canal of a user of the hearing device, comprising:

providing a measurement signal by measuring the fit of the hearing device in the auditory canal;

acoustically playing back the measurement signal;

receiving the measurement signal influenced by the fit of the hearing device in the auditory canal;

comparing the received measurement signal with a predetermined reference;

determining an information about the fit of the hearing device from the comparison; and outputting the information about the fit of the hearing device to an external device, wherein the fit of the hearing device component describes an alignment of the hearing device component with respect to the auditory canal of the user.

13. The method as claimed in claim 12, wherein a status report is output to the external device including the information about the fit of the hearing device.

14. The method as claimed in claim 12, wherein the information about the fit of the hearing device is determined at a regular time interval, or at the time when the hearing device is turned on, or with an activation of a remote control of the hearing device.

15. The method as claimed in claim 12, wherein the fit of the hearing device describes an alignment of the hearing device with respect to the auditory canal of the user.

16. The method as claimed in claim 12, wherein the method determines a fit of the hearing device component in the auditory canal of the user.

* * * * *